US009234143B2

(12) United States Patent
Xie et al.

(10) Patent No.: US 9,234,143 B2
(45) Date of Patent: Jan. 12, 2016

(54) CATALYTIC CRACKING APPARATUS AND PROCESS

(75) Inventors: Chaogang Xie, Beijing (CN); Yongcan Gao, Bejing (CN); Weimin Lu, Beijing (CN); Jun Long, Beijing (CN); Yan Cui, Beijing (CN); Jiushun Zhang, Beijing (CN); Yinan Yang, Beijing (CN); Jianguo Ma, Beijing (CN); Zheng Li, Beijing (CN); Nan Jiang, Beijing (CN)

(73) Assignee: CHINA PETROLEUM & CHEMICAL CORPORATION, Beijing (CN)

( * ) Notice: Subject to any disclaimer, the term of this patent is extended or adjusted under 35 U.S.C. 154(b) by 869 days.

(21) Appl. No.: 13/503,544

(22) PCT Filed: Oct. 29, 2010

(86) PCT No.: PCT/CN2010/001725

§ 371 (c)(1),
(2), (4) Date: May 23, 2012

(87) PCT Pub. No.: WO2011/050587

PCT Pub. Date: May 5, 2011

(65) Prior Publication Data

US 2013/0006028 A1 Jan. 3, 2013

(30) Foreign Application Priority Data

Oct. 30, 2009 (CN) ..... 2009 1 0210331

(51) Int. Cl.

| | |
|---|---|
| ***C10G 51/02*** | (2006.01) |
| ***C10G 51/06*** | (2006.01) |
| ***C10G 11/18*** | (2006.01) |
| ***C10G 11/20*** | (2006.01) |

(52) U.S. Cl.

CPC ..... *C10G 51/06* (2013.01); *C10G 11/18* (2013.01); *C10G 11/20* (2013.01); *C10G 51/026* (2013.01); *C10G 2300/104* (2013.01); *C10G 2300/1014* (2013.01); *C10G 2300/1018* (2013.01); *C10G 2300/301* (2013.01); *C10G 2300/4018* (2013.01); *C10G 2300/4093* (2013.01); *C10G 2300/708* (2013.01); *C10G 2400/02* (2013.01); *C10G 2400/20* (2013.01)

(58) Field of Classification Search

CPC ..... C10G 11/02; C10G 11/18; C10G 11/182; C10G 51/026; C10G 51/06

See application file for complete search history.

(56) References Cited

U.S. PATENT DOCUMENTS 3,784,463 A * 1/1974 Reynolds et al. ..... 208/74
3,856,659 A * 12/1974 Owen ..... C10G 11/18 208/155

(Continued)

FOREIGN PATENT DOCUMENTS

CN 1332781 A 1/2002
CN 1621494 A 6/2005

(Continued)

OTHER PUBLICATIONS

English translation of CN 101293806, provided by Google, Oct. 2008.*

*Primary Examiner* — Renee E Robinson

(74) *Attorney, Agent, or Firm* — Allen Xue; Novick, Kim & Lee, PLLC

(57) ABSTRACT

The present invention discloses catalytic cracking apparatus and process, which are useful for catalytic cracking of heavy oils with a high heavy oil conversion, a high propylene yield and low dry gas and coke yields.

15 Claims, 1 Drawing Sheet

(56) References Cited

U.S. PATENT DOCUMENTS

| | | | | |
|---|---|---|---|---|
| 2009/0117017 | A1* | 5/2009 | Long et al. | 422/190 |
| 2010/0286459 | A1* | 11/2010 | Gauthier et al. | 585/303 |

FOREIGN PATENT DOCUMENTS

| | | | | | |
|---|---|---|---|---|---|
| CN | 101293806 | A | | 10/2008 | |
| WO | WO 2009/007519 | | * | 1/2009 | B01D 45/00 |

* cited by examiner

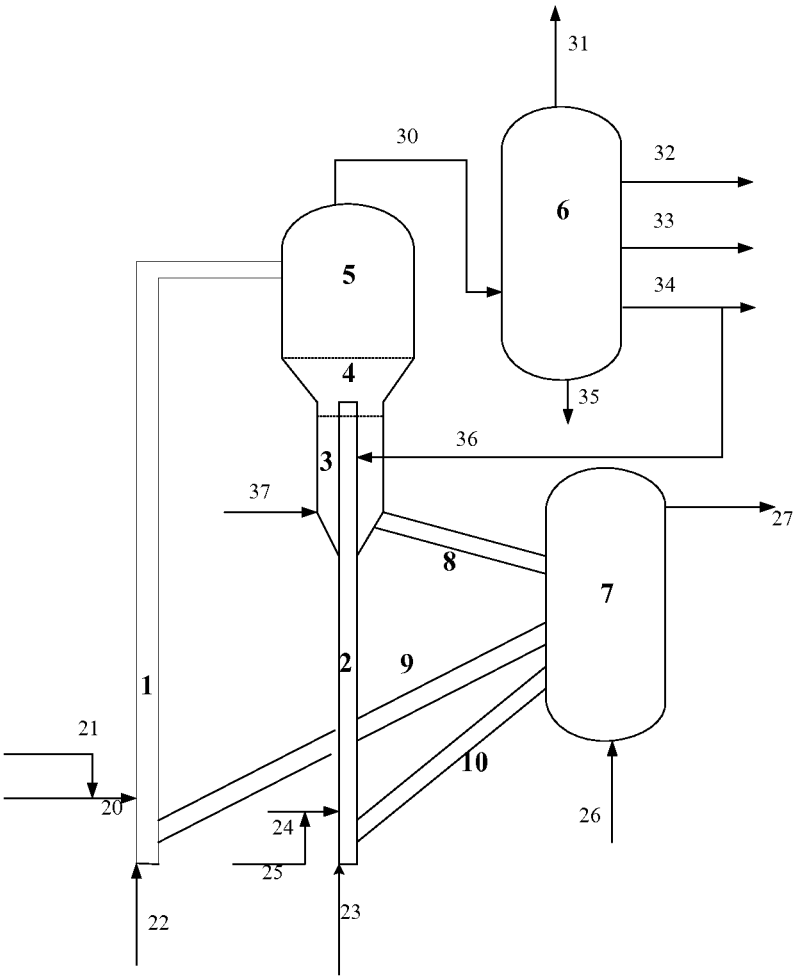
31
30
32
6
33
5
34
4
35
36
3
37
27
8
7
2
9
1
21
10
20
26
24
25
22
23

CATALYTIC CRACKING APPARATUS AND PROCESS

TECHNICAL FIELD

The present invention relates to a catalytic cracking apparatus and process.

BACKGROUND

Heavy oil catalytic cracking is an important process for producing lower olefins such as ethylene, propylene and butylene.

The commercial process of heavy oil catalytic cracking to produce lower olefin includes those disclosed in U.S. Pat. No. 4,980,053, U.S. Pat. No. 5,670,037 and U.S. Pat. No. 6,210,562. These processes use a single riser reactor or a combination of a single riser reactor and a dense bed and have problems of high dry gas and coke yields.

Recently, more and more attentions are paid to the technology of using two risers to produce propylene.

CN101074392A discloses a method for producing propylene and gasoline diesel-oil by two-section catalyzed cracking style, which is carried out by adopting two-section lift pipe catalyzing process and catalyst with molecular sieve, taking heavy petroleum hydrocarbon or various animal and vegetable oils containing hydrocarbon as raw materials, optimization combining by charging style for various reactants, and controlling proper reactive conditions. It can improve propylene and light-oil recovery rate and quality, and inhibit to generate dry gas and coke. Said method has a low propylene yield and a low heavy oil conversion capability.

CN101293806A discloses a catalytic conversion method for improving the yield of low-carbon olefin, which comprises the following steps: hydrocarbon oil raw material is injected into a riser or/and a fluidized bed reactor via a feed nozzle, comes into contact with catalyst containing shape-selective zeolite with an average pore size being smaller than 0.7 nm and reacts; gas rich in hydrogen is injected into the reactor; reaction oil gas and spent catalyst after reaction are separated, wherein the reaction oil gas is separated to obtain a target product containing ethylene and propylene; and the spent catalyst is returned to the reaction for reutilization after being stripped and regenerated. By injecting gas rich in hydrogen, the method can remarkably inhibit reconversion reaction of the generated low-carbon olefin to improve the yield of low-carbon olefin, particularly of propylene. Said method has a limited effect of decreasing the dry gas yield and increasing the heavy oil conversion capability.

CN101314724A discloses a method for catalytically transforming bio-oil and mineral oil combination, which comprises the following steps: contacting bio-oil and mineral oil with catalyst containing modified beta-zeolite in a compound reactor to carry out catalytic cracking reaction, separating the reaction resultant with the spent catalyst, processing the spent catalyst by stripping and burning and adding into the reactor for recycling, introducing the separated resultant from the reactor, and distilling to obtain target product low-carbon alkenes, gasoline, diesel and heavy oil. Said method has a high dry gas yield and a low heavy oil conversion.

SUMMARY OF THE INVENTION

The technical problem to be solved by the present invention is to provide a catalytic cracking apparatus and method for increasing the yield of low olefins (in particular, propylene) and the conversion of the heavy oil.

In one embodiment, the present invention provides a catalytic cracking process, which comprises:

a heavy feedstock and optionally an atomized steam are contacted with a catalyst containing a shape-selective zeolite having an average pore size of less than 0.7 nm in a first riser reactor and reacted to produce a stream containing a first hydrocarbon product and a first coked catalyst, said first hydrocarbon product and said first coked catalyst are separated by a separation device at the end of the first riser, a light feedstock and optionally an atomized steam are introduced into an second riser reactor to contact with a catalyst containing a shape-selective zeolite having an average pore size of less than 0.7 nm and react to produce an second hydrocarbon product and a second coked catalyst, which are introduced into an fluidized bed reactor connected in series with said second riser reactor and reacted in the presence of a catalyst containing a shape-selective zeolite having an average pore size of less than 0.7 nm, a cracked heavy oil, preferably a cracked heavy oil obtained from an own product separation system is introduced into said second riser reactor and/or said fluidized bed reactor, preferably introduced into said fluidized bed reactor to react; and a stream containing a third hydrocarbon product and a third coked catalyst is produced from the fluidized bed reactor.

In one further embodiment, said heavy feedstock comprises heavy hydrocarbons and/or hydrocarbon-rich animal or vegetable oils; wherein said light feedstock comprises gasoline fractions and/or C4 hydrocarbons; wherein said cracked heavy oil is a cracked heavy oil having an atmospheric distillation range of 330-550° C.

In one further embodiment, said catalytic cracking process further comprises: said first hydrocarbon product is separated by a product separation system to produce cracked gas, cracked gasoline, cracked light cycle oil and cracked heavy oil; and/or wherein said third hydrocarbon product is separated by a product separation system to produce cracked gas, cracked gasoline, cracked light cycle oil and cracked heavy oil.

In one further embodiment, said atomized steam in said first riser reactor, relative to said heavy feedstock, comprises 2-50 wt %, preferably 5-10 wt %, the first riser reactor has a reaction pressure of 0.15-0.3 MPa, preferably 0.2-0.25 MPa, a reaction temperature of 480-600° C., preferably 500-560° C., a catalyst/oil ratio of 5-20, preferably 7-15, and a reaction time of 0.50-10 seconds, preferably 2-4 seconds.

In one further embodiment, said second riser reactor has a reaction temperature of 520-580° C., preferably 520-560° C.; in case that said light feedstock introduced into said second riser reactor comprises gasoline fractions, a gasoline feedstock/atomized steam ratio is 5-30 wt %, preferably 10-20 wt %; in case that said light feedstock comprises gasoline fractions, for said gasoline fractions, said second riser has a catalyst/oil of 10-30, preferably 15-25, and a reaction time of 0.10-1.5 seconds, preferably 0.30-0.8 seconds; in case that said light feedstock comprises C4 hydrocarbons, a C4 hydrocarbon/atomized steam ratio is 10-40 wt %, preferably 15-25 wt %, in case that said light feedstock comprises C4 hydrocarbons, for said C4 hydrocarbons, said second riser has a catalyst/oil of 12-40, preferably 17-30, and a reaction time of 0.50-2.0 seconds, preferably 0.8-1.5 seconds. In one further embodiment, said fluidized bed reactor has a reaction temperature of 500-580° C., preferably 510-560° C., a weight hourly space velocity of 1-35 $h^{-1}$, preferably 3-30 $h^{-1}$, and a reaction pressure of 0.15-0.3 MPa, preferably 0.2-0.25 MPa.

In one further embodiment, reaction conditions of the cracked heavy oil in the fluidized bed include: a catalyst/oil ratio of 1-50, preferably 5-40; a weight hourly space velocity of 1-20 $h^{-1}$, preferably 3-15 $h^{-1}$; an atomized steam/cracked heavy oil ratio of 5-20 wt %, preferably 10-15 wt %.

In one further embodiment, a weight ratio of said cracked heavy oil introduced into said second riser reactor and/or said fluidized bed reactor to said heavy feedstock introduced into said first riser reactor is 0.05-0.30:1.

In one further embodiment, in case that said light feedstock comprises gasoline fractions, a weight ratio of said gasoline fraction introduced into said second riser reactor to said heavy feedstock introduced into said first riser reactor is 0.05-0.20:1; in case that said light feedstock comprises gasoline fractions and C4 hydrocarbons, a weight ratio of C4 hydrocarbons in said light feedstock to said gasoline fraction in said light feedstock is 0-2:1.

In one further embodiment, said light feedstock of gasoline fraction is an olefin-rich gasoline fraction, which has an olefin content of 20-95 wt % and a final boiling point of not more than 85° C.; and said light feedstock of C4 hydrocarbon is an olefin-rich C4 hydrocarbon which has a C4-olefin content of more than 50 wt %.

In one further embodiment, said gasoline feedstock comprises said cracked gasoline produced by separation from said product separation system.

In one further embodiment, the catalytic cracking process further comprises mixing said first hydrocarbon product and said third hydrocarbon product and introducing them into said product separation system for separation.

In one further embodiment, the catalytic cracking process further comprises introducing said first coked catalyst into said fluidized bed reactor, mixing with the catalyst of the fluidized bed reactor, and then introducing into a stripper, or introducing said first coked catalyst directly into a stripper.

In one further embodiment, the catalytic cracking process further comprises stripping said first coked catalyst and/or said third coked catalyst with steam and introducing a stripping steam entrained with hydrocarbon products into said fluidized bed reactor.

In one embodiment, the present invention provides a catalytic cracking apparatus, which comprises:

a first riser reactor (1) for cracking a heavy feedstock, said first riser reactor has one or more heavy feedstock inlets situated at the bottom of said riser, a second riser reactor (2) for cracking a light feedstock, said second riser reactor has one or more light feedstock inlets situated at the bottom of said riser and an outlet situated at the top of said riser, a fluidized bed reactor (4), said fluidized bed reactor has one or more inlets and said fluidized bed reactor is connected to said outlet of said second riser reactor by a connector, preferably a low-pressure outlet distributor, more preferably an arch distributor, a separation device, preferably a quick separation device, disposed at the end of the first riser, wherein said separation device comprises a hydrocarbon outlet and a catalyst outlet, wherein said second riser reactor and/or said fluidized bed reactor further have one or more cracked heavy oil inlets above said one or more light feedstock inlets, preferably, said cracked heavy oil inlet(s) is/are between the half of the length of said second riser reactor and said second riser outlet, more preferably said cracked heavy oil inlet(s) is/are at the bottom of said fluidized bed reactor, and optionally, a product separation system (6), wherein said product separation system separates a cracked heavy oil from the hydrocarbon product from said first riser reactor and/or said fluidized bed reactor, and said cracked heavy oil is introduced into one or more cracked heavy oil inlets by a cracked heavy oil loop.

In one further embodiment, said catalytic cracking apparatus further comprises: a stripper (3), a disengager (5), the product separation system (6), a regenerator (7) and a cyclone separation system:

wherein said stripper has a stripping steam inlet, a stripped catalyst outlet and an outlet for stripping steam entrained with hydrocarbon;

wherein said disengager is communicated with the outlet for said fluidized bed reactor, and has one or more inlets for receiving the reaction hydrocarbon and one or more outlets connected with the product separation system;

wherein said regenerator comprises a regeneration section, one or more spent catalyst pipelines and one or more regenerated catalyst pipelines, wherein preferably the spent catalyst pipeline(s) is/are connected with the stripper, and the regenerated catalyst pipeline(s) is/are connected with said first and/or second riser reactor;

wherein said product separation system separates C4 hydrocarbons, cracked gasoline, and cracked heavy oil from the hydrocarbon product from said first riser reactor and/or said fluidized bed reactor, and said cracked heavy oil is introduced into one or more cracked heavy oil inlets by a cracked heavy oil loop, and/or said cracked gasoline is introduced into said one or more light feedstock inlets by a cracked gasoline loop, and/or said C4 hydrocarbon is introduced into said one or more light feedstock inlets by a C4 hydrocarbon loop;

wherein said cyclone separation system is set on the top of the disengager and is connected with the disengager outlet and it further separates hydrocarbon products and catalyst solid particulates.

In one further embodiment, said first riser reactor is selected from an iso-diameter riser, an equal-velocity riser or an variable-diameter riser; said second riser reactor is selected from an iso-diameter riser, an equal-velocity riser or an variable-diameter riser; said fluidized bed reactor is selected from a fixed fluidized bed, a particulately fluidized bed, a bubbling bed, a turbulent bed, a fast bed, a transport bed and a dense bed.

Based on the combination of two risers and a fluidized bed, the heavy oil conversion is effectively increased, the propylene yield is substantially increased, and the properties of cracked gasoline and cracked light cycle oil can be improved by optimizing the process flow, providing a suitable catalyst, and selectively converting different feedstocks. Comparing with the prior art, the first hydrocarbon product and the first coked catalyst is separated by the separation device (the quick separation device) at the end of the first riser reactor; therefore, the dry gas yield can be lowered, and the further conversion can be inhibited after the formation of lower olefin, in particular, propylene. In the present invention, the olefin-rich gasoline fraction and/or the olefin-rich C4 hydrocarbons are injected as feedstock into the second riser reactor connected to the fluidized bed reactor, and the apparatus/process-self-produced cracked heavy oil is introduced into the second riser reactor and/or the fluidized bed reactor to take part in the conversion reaction. In one hand, the second conversion of the heavy oil increase the heavy oil conversion depth for the whole apparatus/process, and the cracked heavy oil fraction is utilized to increase the propylene yield; in the other hand, the termination by quenching the reaction of the olefin-rich gasoline fraction and/or C4 hydrocarbons inhibits the further conversion after the formation of lower olefin, in particular, propylene so as to effectively maintain a high propylene yield. Moreover, according to the present invention, the stripping steam entrained with hydrocarbon products is introduced into the fluidized bed reactor and withdrawn through the fluidized bed reactor, therefore, the hydrocarbon product partial pressure can be effectively decreased and the residence time of the hydrocarbon product in the disengager can be shortened so as to increase the propylene production and decrease the yields of dry gas and coke.

THE DESCRIPTION OF THE DRAWINGS

FIG. 1 is a schematic flowchart according to the catalytic cracking process of the present invention, in which, elements 1 and 2 represent riser reactors, element 3 represents a stripper, element 4 represents a fluidized bed reactor, element 5 represents a disengager, element 6 represents a product separation system, element 7 represents a regenerator, element 8 represents a spent catalyst pipeline, elements 9 and 10 represent regenerated catalyst pipelines, wherein, the riser 2 is coaxially connected in series with the fluidized bed 4, communicated in parallel with the riser 1 by the disengager 5 and connected coaxially with the stripper 3 with the substantially same high and low levels.

THE BEST MODES OF CARRYING OUT THE PRESENT INVENTION

Definition

In the present invention, unless indicated otherwise, the reaction temperature of the riser reactor refers to the outlet temperature of the riser reactor; the reaction of the fluidized bed reactor refers to the bed temperature of the fluidized bed reactor.

In the present invention, unless indicated otherwise, the catalyst/oil ratio refers to a weight ratio of the catalyst to oil/hydrocarbon.

In the present invention, unless indicated otherwise, the reaction pressure of the riser reactor refers to the outlet absolute pressure of the reactor.

In the present invention, unless indicated otherwise, the terms "gasoline fraction" and "gasoline feedstock" are used interchangeably.

In the present invention, unless indicated otherwise, the gasoline feedstock/atomized steam ratio refers to the ratio of the atomized steam for gasoline to the gasoline feedstock.

In the present invention, unless indicated otherwise, the C4 hydrocarbon/atomized steam ratio refers to the ratio of the atomized steam for C4 hydrocarbon to the C4 hydrocarbon feedstock.

In the present invention, unless indicated otherwise, the atomized steam/cracked heavy oil ratio refers to the ratio of the atomized steam for the cracked heavy oil to the cracked heavy oil feedstock.

In the present invention, unless indicated otherwise, the reaction pressure of the fluidized bed reactor refers to the outlet absolute pressure of the reactor; and in case that the fluidized bed reactor is connected to the disengager, it refers to the outlet absolute pressure of the disengager.

In the present invention, unless indicated otherwise, the weight hourly space velocity of the fluidized bed is relative to the total feedstock of the fluidized bed reactor.

In the present invention, unless indicated otherwise, the quick separation device is a cyclone separator which is capable of quickly separating the catalyst solid and the hydrocarbon product, preferably, said cyclone separator is a primary cyclone separator.

According to the present invention, a heavy feedstock and optionally an atomized steam is catalytically cracked in the first riser reactor to produce a stream containing first hydrocarbon product and first coked catalyst, and said first hydrocarbon product and said first coked catalyst are separated by a separation device at the end of the first riser. In one embodiment, said separation device is a quick separation device for quickly separating the coked catalyst solid and the hydrocarbon product. In one embodiment, the existing quick separation device is used. Preferably, the quick separation device is a primary cyclone separator.

The reaction and operation conditions in the first riser reactor are: the reaction temperature is 480-600° C., preferably 500-560° C., the catalyst/oil ratio is 5-20, preferably 7-15, the reaction time is 0.50-10 seconds, preferably 2-4 seconds, the atomized steam comprises 2-50 wt %, preferably 5-10 wt %, of the total of said heavy feedstock and said atomized steam, the reaction pressure is 0.15-0.3 MPa, preferably 0.2-0.25 MPa.

According to the present invention, a light feedstock and optionally an atomized steam are introduced into an second riser reactor to contact with a catalyst containing a shape-selective zeolite having an average pore size of less than 0.7 nm and react to produce an second hydrocarbon product and a second coked catalyst, which are introduced into an fluidized bed reactor connected in series with said second riser reactor and reacted in the presence of a catalyst containing a shape-selective zeolite having an average pore size of less than 0.7 nm, a cracked heavy oil, preferably a process-self-produced cracked heavy oil is introduced into said second riser reactor and/or said fluidized bed reactor, preferably introduced into said fluidized bed reactor to react; and a stream containing a third hydrocarbon product and a third coked catalyst is produced from the fluidized bed reactor. The stream containing the third hydrocarbon product and the third coked catalyst is passed through a disengager to accomplish a separation of the third hydrocarbon product and the third coked catalyst. The third hydrocarbon product is introduced into a product separation system to produce cracked gas, cracked gasoline, cracked light cycle oil and cracked heavy oil.

The light feedstock introduced into the second riser reactor is a gasoline fraction and/or a C4 hydrocarbon, preferably an olefin-rich C4 hydrocarbon and/or an olefin-rich gasoline fraction. The reaction temperature of the second riser is about 520-580° C., preferably 520-560° C. The reaction and operation conditions of said gasoline fraction introduced into said second riser reactor are: the catalyst/oil ratio of the gasoline feedstock in the second riser is 10-30, preferably 15-25; the reaction time of the gasoline feedstock in the second riser is 0.10-1.5 seconds, preferably 0.30-0.8 seconds; and the gasoline feedstock/atomized steam ratio is 5-30 wt %, preferably 10-20 wt %. The reaction and operation conditions of the C4 hydrocarbon are: the catalyst/oil ratio of said C4 hydrocarbon in the second riser is 12-40, preferably 17-30; the reaction time of the C4 hydrocarbon in the second riser is 0.50-2.0 seconds, preferably 0.8-1.5 seconds; and the C4 hydrocarbon/atomized steam ratio is 10-40 wt %, preferably 15-25 wt %.

According to the present invention, the reaction and operation conditions in the fluidized bed reactor includes: the reaction pressure is 0.15-0.3 MPa, preferably 0.2-0.25 MPa; the reaction temperature of the fluidized bed is about 500-580° C., preferably 510-560° C.; the weight hourly space velocity of the fluidized bed is 1-35 $h^{-1}$, preferably 3-30 $h^{-1}$.

According to the present invention, the reaction and operation conditions of the cracked heavy oil fraction in the second riser reactor and/or the fluidized bed reactor are: the catalyst/oil ratio of the cracked heavy oil is 1-50, preferably 5-40; the weight hourly space velocity is 1-20 $h^{-1}$, preferably 3-15 $h^{-1}$, the atomized steam/cracked heavy oil ratio is 5-20 wt %, preferably 10-15 wt %.

According to the present invention, the light feedstock introduced into the second riser reactor is preferably an olefin-rich gasoline fraction and/or an olefin-rich C4 hydrocarbon, wherein the feedstock of said olefin-rich gasoline fraction is selected from the gasoline fraction produced by the present apparatus and the gasoline fraction produced by the other apparatus, preferably, said cracked gasoline produced by separation from said product separation system. The gasoline fraction produced by the other apparatus may be selected from one or more of catalytically cracked crude gasoline, catalytically cracked stabilized gasoline, coke gasoline, visbroken gasoline and gasoline fractions produced by other oil refining or chemical engineering processes. The olefin content of the olefin-rich gasoline feedstock is 20-95 wt %, preferably 35-90 wt %, more preferably 50 wt % or more. Said gasoline feedstock can be a full-range gasoline fraction having a final boiling point not more than 204° C., and also can be a narrow cut therein, for example, a gasoline fraction having a distillation range of 40-85° C. The weight ratio of said gasoline fraction introduced into said second riser reactor to said heavy feedstock introduced into said first riser reactor is 0.05-0.20:1, preferably 0.08-0.15:1. The C4 hydrocarbon refers to a low molecular hydrocarbon, which is mainly composed of C4 fractions, and exists in a gaseous form at normal temperature (such as 0-20° C.) under normal pressure (such as 1 atm), and includes alkanes, olefins and alkynes having 4 carbon atoms.

The C4 hydrocarbon can be a C4-fraction-rich gaseous hydrocarbon product produced by the present apparatus, and can be also a C4-fraction-rich gaseous hydrocarbon produced by the other apparatus, wherein the feedstock of said olefin-rich gasoline fraction is selected from the gasoline fraction produced by the present apparatus and the gasoline fraction produced by the other apparatus, preferably, the gasoline fraction produced by the present apparatus. Said C4 hydrocarbon is preferably an olefin-rich C4 fraction having a C4 olefin content of more than 50 wt %, preferably more than 60 wt %, more preferably more than 70 wt %. In one embodiment, the weight ratio of the C4 hydrocarbon to the gasoline fraction in the light feedstock is 0-2:1, preferably 0-1.2:1, more preferably 0-0.8:1.

According to the present invention, the light feedstock and optionally the atomized steam are introduced into the second riser reactor to react in the second riser reactor and produce a second hydrocarbon product and a second coked catalyst, which are introduced into the fluidized bed reactor to continue the reaction, and the cracked heavy oil produced from the product separation system of the present invention is introduced into the second riser reactor to react and/or introduced into the fluidized bed reactor to react. In one embodiment, the cracked heavy oil is introduced into the second riser reactor, wherein the introduction position of the cracked heavy oil is higher than that of the light feedstock, preferably, the introduction position of the cracked heavy oil is between the half of the riser length (the part from the gasoline inlet of the riser to the riser outlet) and the riser outlet. In one embodiment, said cracked heavy oil is introduced into the fluidized bed reactor, preferably, into the bottom of the fluidized bed reactor. The cracked heavy oil is the cracked heavy oil produced from the product separation system of the present invention, i.e. a majority of the liquid product left after separating the gas, the gasoline and the diesel from the hydrocarbon product introduced into the product separation system, and has an atmospheric distillation range of 330-550° C., preferably 350-530° C. The weight ratio of the cracked heavy oil injected into the second riser or injected into the fluidized bed reactor or injected into the second riser and the fluidized bed reactor to the heavy feedstock injected into the first riser reactor is 0.05-0.30:1, preferably 0.10-0.25:1. The actual reprocessing amount of the cracked heavy oil depends on the reaction depth in the first riser, and the larger the reaction depth is, the less the reprocessing amount of the cracked heavy oil. Preferably, when injecting the cracked heavy oil into the reactor, the carbon-deposition amount on the catalyst is less than 0.5 wt %, preferably 0.1-0.3 wt %. The introduction of the cracked heavy oil between the half of the riser length and the riser outlet or into the riser reactor can decrease the yields of dry gas and coke and increase the propylene selectivity.

According to the present invention, the separation device at the end of the first riser reactor separates the first hydrocarbon product from the first coked catalyst, and the first hydrocarbon product is introduced into the product separation system for separation. The third hydrocarbon product leaving the fluidized bed reactor firstly comes into the disengager, and after settling to separate the catalyst, comes into the subsequent product separation system. In the product separation system, the hydrocarbon product is separated to produce cracked gas, cracked gasoline, cracked light cycle oil and cracked heavy oil. Preferably, the first hydrocarbon product and the third hydrocarbon product share a common product separation system, wherein the first hydrocarbon product and the third hydrocarbon product are mixed and then introduced into the product separation system. Said product separation system is well known in the prior art, and there is no particular limitation on the product separation system in the present invention.

According to the present invention, the first coked catalyst produced by separation from the separation device at the end of the first riser reactor can be directly introduced into the stripper, or can be firstly introduced into the fluidized bed reactor, and after mixing with the catalyst in the fluidized bed reactor, introduced into the stripper. Preferably, the first coked catalyst is firstly introduced into the fluidized bed reactor, through the fluidized bed reactor, and then into the stripper. The catalyst leaving the fluidized bed reactor (i.e., the third coked catalyst) is introduced into the stripper. The first coked catalyst and the third coked catalyst are preferably stripped in the same stripper. The stripped catalyst is introduced into a regenerator. The regenerated catalyst is introduced into the first riser reactor and/or the second riser reactor for recycle use.

According to the present invention, the stripping steam and the stripped hydrocarbon products are introduced into the bottom of the fluidized bed reactor and withdrawn through the fluidized bed reactor, therefore, the hydrocarbon product partial pressure can be decreased and the residence time of the hydrocarbon product in the disengager can be shortened so as to increase the propylene production and decrease the yields of dry gas and coke.

The heavy feedstock according to the present invention includes heavy hydrocarbons or hydrocarbon-rich animal or vegetable oils. Said heavy hydrocarbon is selected from one or more of petroleum hydrocarbons, mineral oils and synthetic oils. Said petroleum hydrocarbons are well known by the skilled person in the art, and include vacuum wax oil, atmospheric residual oil, a blend of vacuum wax oil and vacuum residual oil, or other hydrocarbon oils produced by second processing. Said other hydrocarbon oils produced by second processing include one or more of coking wax oil, deasphalted oil, and furfural raffinate. Said mineral oils include one or more of coal liquefaction oil, oil-sand oil and shale oil. The synthetic oils include fractional oils produced by the F-T synthesis from coal, natural gas or asphaltene. Said hydrocarbon-rich animal or vegetable oils are one or more of animal or vegetable fats and oils.

According to the present invention, there is provided a catalytic cracking apparatus, which comprises:

a first riser reactor (1) for cracking a heavy feedstock, said first riser reactor has one or more heavy feedstock inlets situated at the bottom of said riser, a second riser reactor (2) for cracking a light feedstock, said second riser reactor has one or more light feedstock inlets situated at the bottom of said riser and an outlet situated at the top of said riser, a fluidized bed reactor (4), said fluidized bed reactor has one or more inlets and said fluidized bed reactor is connected to said outlet of said second riser reactor by a connector, preferably a low-pressure outlet distributor, more preferably an arch distributor, a separation device, preferably a quick separation device, disposed at the end of the first riser, wherein said separation device comprises a hydrocarbon outlet and a catalyst outlet, wherein said second riser reactor and/or said fluidized bed reactor further have one or more cracked heavy oil inlets above said one or more light feedstock inlets, preferably, said cracked heavy oil inlet(s) is/are between the half of the length of said second riser reactor and said second riser outlet, more preferably said cracked heavy oil inlet(s) is/are at the bottom of said fluidized bed reactor, and optionally, a product separation system (6), wherein said product separation system separates a cracked heavy oil from the hydrocarbon product from said first riser reactor and/or said fluidized bed reactor, and said cracked heavy oil is introduced into one or more cracked heavy oil inlets by a cracked heavy oil loop.

In one further embodiment, the present provides a catalytic cracking apparatus, which further comprises: a stripper (3), a disengager (5), the product separation system (6), a regenerator (7) and a cyclone separation system.

In one further embodiment, wherein said stripper has a stripping steam inlet, a stripped catalyst outlet and an outlet for stripping steam entrained with hydrocarbon.

In one further embodiment, wherein said disengager is communicated with the outlet for said fluidized bed reactor, and has one or more inlets for receiving the reaction hydrocarbon and one or more outlets connected with the product separation system.

In one further embodiment, wherein said regenerator comprises a regeneration section, one or more spent catalyst pipelines and one or more regenerated catalyst pipelines, wherein preferably the spent catalyst pipeline(s) is/are connected with the stripper, and the regenerated catalyst pipeline(s) is/are connected with said first and/or second riser reactor;

In one further embodiment, wherein said product separation system separates C4 hydrocarbons, cracked gasoline, and cracked heavy oil from the hydrocarbon product from said first riser reactor and/or said fluidized bed reactor, and said cracked heavy oil is introduced into one or more cracked heavy oil inlets by a cracked heavy oil loop, and/or said cracked gasoline is introduced into said one or more light feedstock inlets by a cracked gasoline loop, and/or said C4 hydrocarbon is introduced into said one or more light feedstock inlets by a C4 hydrocarbon loop.

In one further embodiment, wherein said cyclone separation system is set on the top of the disengager and is connected with the disengager outlet and it further separates hydrocarbon products and catalyst solid particulates.

According to the present invention, the catalytic cracking apparatus is preferably provided with the combination of two risers and a fluidized bed, wherein one rises is coaxially connected in series with the fluidized bed, and the coaxial in series combination of said one riser and the fluidized bed is communicated in parallel with the other riser and further coupled coaxially with the stripper.

In the coaxial in series combination of said one riser and the fluidized bed, the riser outlet is preferably provided with a low-pressure outlet distributor having a pressure drop of below 10 KPa. An existing low-pressure outlet distributor, such as an arch distributor, can be used.

According to the present invention, said riser reactor is selected from one or more of an iso-diameter riser, an equal-velocity riser and an variable-diameter riser, wherein the first riser reactor and the second riser reactor can take the same or different reactor types. Said fluidized bed reactor is selected from one or more of a fixed fluidized bed, a particulately fluidized bed, a bubbling bed, a turbulent bed, a fast bed, a transport bed and a dense bed.

According to the present invention, the shape-selective zeolite having an average pore size of less than 0.7 nm is selected from one or more of ZSM zeolites, ZRP zeolites, ferrierite, chabasite, dachiardite, erionite, zeolite A, epistilbite, laumontite, and physically and/or chemically modified zeolites thereof. Said ZSM zeolite is selected from one or more of ZSM-5, ZSM-8, ZSM-11, ZSM-12, ZSM-22, ZSM-23, ZSM-35, ZSM-38, ZSM-48 and other zeolites having similar structures. For more detailed description of ZSM-5, a reference may be made to U.S. Pat. No. 3,702,886. For the more detailed description of ZRP, a reference may be made to U.S. Pat. No. 5,232,675.

Said catalyst containing a shape-selective zeolite having an average pore size of less than 0.7 nm can be one or more catalysts as provided by the prior art, or commercially available or prepared by the well known methods in the prior art. Said catalyst contains zeolite, inorganic oxides, and optionally clay. Preferably, said catalyst contains 5-50 wt % zeolite, 5-95 wt % inorganic oxides, and 0-70 wt % clay. Said zeolite comprises a shape-selective zeolite having an average pore size of less than 0.7 nm and optionally a large-pore zeolite. The shape-selective zeolite having an average pore size of less than 0.7 nm comprises 25-100 wt %, preferably 50-100 wt % of active components. Said large-pore zeolite comprises 0-75 wt %, preferably 0-50 wt % of active components.

Said large-pore zeolite is a zeolite of porous structure having a ring opening of at least 0.7 nm, and is selected from one or more of Y-zeolite, β-zeolite, L-zeolite, rare earth Y-zeolite (REY), rare earth HY-zeolite, ultra-stabilized Y-zeolite (USY), and rare earth ultra-stabilized Y-zeolite (REUSY).

Said inorganic oxide is used as binders and selected from silica ($SiO_2$) and/or alumina ($Al_2O_3$). Said clay is used as matrix, i.e., carrier, and selected from kaolin and/or halloysite.

According to the present invention, the catalyst containing a shape-selective zeolite having an average pore size of less than 0.7 nm used in the second riser reactor and that used in the first riser can be identical or not. Preferably, the catalyst used in the first riser reactor and that used in the second riser reactor are identical.

The following detailed description of preferred embodiments of the invention will be made in reference to the accompanying drawings. The provided examples are merely illustrative and are not to be taken as limitations upon the scope of the invention, which is defined solely by the appended claims and their equivalents. Various changes and modifications to the disclosed embodiments will be apparent to those skilled in the art and can be made without departing from the spirit and scope thereof.

In the process as shown in FIG. 1, hot regenerated catalysts come into the bottoms of the riser reactors 1 and 2 via regenerated catalyst pipelines 9 and 10, and flow up under the action of the pre-lifting media injected via pipelines 22 and 23 respectively. The preheated heavy feedstock from pipeline 20 and the atomized steam from pipeline 21 are mixed in a predetermined ratio, and injected into the riser reactor 1 to react and produce a first hydrocarbon product and a first coked catalyst, wherein said first hydrocarbon product and said first coked catalyst are separated in a quick separation device at the end of the riser 1 (not shown). Optionally preheated olefin-rich gasoline fraction and/or C4 hydrocarbon from the pipeline 24 and the atomized steam from the pipeline 25 are mixed in a predetermined ratio and injected into the riser reactor 2, flow up along the riser 2 together with the catalyst, and contact with a stream containing the cracked heavy oil (preferably the self-produced cracked heavy oil) and a certain ratio of the atomized product introduced via pipeline 36 and react to produce a second hydrocarbon product and a second coked catalyst. The second hydrocarbon product and the second coked catalyst enter the fluidized bed reactor 4 via the outlet distributor of the riser 2 (not shown) to continue reacting to produce a third hydrocarbon product and a third coked catalyst, which enter the disengager 5 to separate the hydrocarbon product and the catalyst. The hydrocarbon product, comprising both the first hydrocarbon product and the third hydrocarbon product, is introduced into the cyclone separation system (not shown) on the top of the disengager to separate out the entrained solid such as catalyst, and then introduced into the product separation system 6 via pipeline 30. In the product separation system 6, the catalytic cracking product is separated into cracked gas (withdrawn via pipeline 31), cracked gasoline (withdrawn via pipeline 32), cracked light cycle oil (withdrawn via pipeline 33), cracked heavy oil (withdrawn via pipeline 34) and cracked oil slurry (withdrawn via pipeline 35). The cracked gas withdrawn via pipeline 31 is separated in a subsequent separator and refined to produce a polymer-grade propylene and an olefin-rich C4 fraction, wherein said olefin-rich C4 fraction can be recycled back to the second riser reactor 2. A part or all of the cracked gasoline withdrawn via pipeline 32 can be recycled back to the second riser reactor 2; or the cracked gasoline can be cut into a light gasoline fraction and a heavy gasoline fraction, and a part or all of the light gasoline fraction is recycled back to the second riser reactor 2. Preferably the light gasoline fraction is recycled back to the second riser reactor 2. The cracked heavy oil withdrawn via pipeline 34 can be recycled back to any reactor of the present catalytic cracking apparatus. Preferably, a part or all of the cracked heavy oil is recycled back via pipeline 36 to the riser 2 or the fluidized bed 4, preferably to the riser 2 after the introduction of the olefin-rich gasoline fraction. The first coked catalyst, which is separated by the quick separation device at the end of the riser 1, is introduced into the fluidized bed reactor 4, mixed with the catalyst at the outlet of the riser 2, and introduced into the stripper 3 after the reaction. The stripping steam is injected via pipeline 37, counter-currently contacts the coked catalyst, strips off the hydrocarbon product entrained by the coked catalyst as much as possible, and is then introduced into the disengager 5 via the fluidized bed reactor 3. The stripped catalyst is sent via the spent catalyst pipeline 8 to the regenerator 7 to burn the coke and regenerate. An oxygen-containing gas such as air is introduced to the regenerator 7 via the pipeline 26. The regeneration flue gas is withdrawn via pipeline 27. The regenerated catalysts are recycled to the riser reactors 1 and 2 via the regenerated catalyst pipelines 9 and 10 respectively for recycle use.

In the above exemplified embodiment, the pre-lifting media are introduced into the risers 1 and 2 via the pipelines 22 and 23 respectively. Said pre-lifting medium is well known in the relevant art, and can be selected from one or more of steam, C1-C4 hydrocarbons or conventional catalytic cracking dry gas; preferably steam and/or olefin-rich C4 fraction.

The following Examples will further demonstrate the present invention.

The feedstock used in Examples and Comparative Examples include feedstock A, B, C, E and F, the properties of which are listed in Table 1. The feedstock A is a cracked heavy oil. The feedstock B is an atmospheric heavy oil. The feedstock C is an olefin-rich cracked light gasoline. The feedstock E and F are two different side liquid products from a Fischer-Tropsch plant and correspond to a light stream and a heavy stream respectively.

The used catalyst is MMC-2 catalyst produced by SINOPEC CATALYST QILU BRANCH COMPANY, the properties of which are listed in Table 2. Said catalyst contains a shape-selective zeolite having an average pore size of less than 0.7 nm.

Example 1

This example was carried out in a pilot apparatus. The feedstock is a mixture of the olefin-rich cracked light gasoline C and the cracked heavy oil A (at the ratio of C:A=1:1.5). The catalyst was MMC-2. In the pilot apparatus operating in a continuous reaction-regeneration manner, the inner diameter of the riser reactor was 16 mm, the height of the same was 3200 mm, and the outlet of the riser reactor was connected to the fluidized bed reactor, wherein the inner diameter of the fluidized bed reactor was 64 mm and the height of the same was 600 mm. All the feeds entered the apparatus through the nozzle at the bottom of the riser reactor to participate in the reaction.

This example was conducted in one-through operation mode without the reprocessing of the cracked heavy oil. A high-temperature regenerated catalyst entered the bottom of the reaction section of the riser reactor via the regenerated catalyst pipeline from the regenerator, and flowed upwards under the action of the steam pre-lifting medium. After preheating and mixing with the atomized steam, the feedstock entered the riser reactor via the feed nozzle and contacted with the hot regenerated catalyst to conduct the catalytic conversion reaction. The reaction mixture flowed up along the riser reactor and through the outlet of the riser reactor, and entered the fluidized bed which is connected with the riser reactor to react. The reaction mixture continued to flow up, entered the disengager after the reaction, and then conducted a gas-solid separation by a quick separation device set on the top of the disengager. The hydrocarbon product was removed via pipeline from the reactor and separated into gas products and liquid products. The coke-containing catalyst (the spent catalyst) flowed into the stripper due to its gravity. The stripping steam, after stripping off the hydrocarbon products absorbed on the spent catalyst, entered the disengager through the fluidized bed to conduct the gas-solid separation. The stripped spent catalyst entered the regenerator via the spent catalyst pipeline to contact with air to burn coke and regenerate at a high temperature. The regenerated catalyst was recycled back to the riser reactor via the regenerated catalyst pipeline for recycle use.

The major operation conditions and results of this example are listed in Table 3.

Comparative Example 1

The feedstock and the catalyst used in this example and the feeding mode of the feedstock in this example were the same as those in the Example 1 except that only the riser reactor but not the fluidized bed reactor was used. The inner diameter of the riser reactor was 16 mm and the height thereof was 3800 mm.

This example was also conducted in one-through operation mode without the reprocessing of the cracked heavy oil. A high-temperature regenerated catalyst entered the bottom of the reaction section of the riser reactor via the regenerated catalyst pipeline from the regenerator, and flowed upwards under the action of the pre-lifting medium. After pre-heating and mixing with the atomized steam, the feedstock entered the riser reactor via the feed nozzle and contacted with the hot regenerated catalyst to conduct the catalytic conversion reaction. The reaction mixture flowed up along the riser reactor, entered the disengager through the outlet of the riser reactor, and then conducted a gas-solid separation by a quick separation device set on the top of the disengager. The hydrocarbon product was removed via pipeline from the reactor and separated into gas products and liquid products. The coke-containing catalyst (the spent catalyst) flowed into the stripper due to its gravity. The stripping steam, after stripping off the hydrocarbon products absorbed on the spent catalyst, entered the disengager to conduct the gas-solid separation. The stripped spent catalyst entered the regenerator via the spent catalyst pipeline to contact with air to burn coke and regenerate at a high temperature. The regenerated catalyst was recycled back to the riser reactor via the regenerated catalyst pipeline for recycle use.

The major operation conditions and results of this example are listed in Table 3.

Example 2

This example was carried out in the pilot apparatus as mentioned in Example 1. The olefin-rich cracked light gasoline C and the cracked heavy oil A were injected at a ratio of 1:1, wherein the feedstock C was injected into the riser reactor through the feeding nozzle at the bottom of the riser reactor and the feedstock A was injected into the riser reactor through the feeding nozzle at the half of the riser reactor length to take part in the reaction.

The major operation conditions and results of this example are listed in Table 4.

Example 3

This example was carried out in the pilot apparatus as mentioned in Example 1. The olefin-rich cracked light gasoline C and the cracked heavy oil A were injected at a ratio of 1:1.2, wherein the feedstock C was injected into the riser reactor through the feeding nozzle at the bottom of the riser reactor and the feedstock A was injected into the riser reactor through the feeding nozzle at the bottom of the fluidized bed to take part in the reaction.

The major operation conditions and results of this example are listed in Table 4.

Comparative Example 2

This example was carried out in the pilot apparatus as mentioned in Comparative Example 1. The olefin-rich cracked light gasoline C and the cracked heavy oil A were injected at a ratio of 1:1, wherein the feedstock C was injected into the riser reactor through the feeding nozzle at the bottom of the riser reactor and the feedstock A was injected into the riser reactor through the feeding nozzle at the half of the riser reactor length to take part in the reaction.

The major operation conditions and results of this example are listed in Table 4. From the Table 4, it can be seen that the feeding mode of the feedstock C being injected into the riser reactor through the feeding nozzle at the bottom of the riser reactor and the feedstock A being injected into the riser reactor through the feeding nozzle at the bottom of the fluidized bed as mentioned in Example 3, compared with the Comparative Example 2, in the conditions that the heavy oil conversion depths were substantially identical, the yields of dry gas and coke were remarkably decreased (by 1.73% and 0.68% respectively), the yields of propylene and butylenes increased by 1.15% and 0.28%, and the dry gas selective index (the ratio of the dry gas yield to the conversion) was 6.25 and decreased by 23.17% relative to that of the Comparative Example 2.

Example 4

This example was carried out in a pilot apparatus as shown in FIG. 1 wherein the inner diameter of the first riser reactor was 16 mm, the height of the same was 3800 mm; the inner diameter of the second riser reactor is 16 mm, the height of the same is 3200 mm; the outlet of the second riser reactor was connected to the fluidized bed reactor; the inner diameter of the fluidized bed reactor was 64 mm, the height of the same was 600 mm.

This example was operated with recycling mode. A high-temperature regenerated catalyst entered the bottom of the reaction sections of the first riser reactor and the second riser reactor respectively via the regenerated catalyst pipelines from the regenerator, and flowed upwards under the action of the pre-lifting medium. After pre-heating and mixing with the atomized steam, the feedstock B entered the first riser reactor 1 via the feed nozzle and contacted with the hot regenerated catalyst to conduct the catalytic conversion reaction. The reaction mixture flowed up along the riser reactor 1 and was subjected to a gas-solid separation by a quick separation device at the outlet of the riser reactor 1. The hydrocarbon product entered the disengager and then was introduced into a product separation system to be separated into gas products and liquid products, wherein the light gasoline fraction was recycled as the feedstock of the second riser reactor 2, the cracked heavy oil fraction was reprocessed as the feedstock of the fluidized bed reactor 3 to continue the catalytic conversion. A coke-containing catalyst (a spent catalyst) from the riser 1 firstly flowed into the fluidized bed reactor 3 due to its gravity, mixed with the catalyst and the hydrocarbon product at the outlet of the riser reactor 2, and then entered a stripper communicated with the fluidized bed. The stripping steam, after stripping off the hydrocarbon products absorbed on the spent catalyst, entered the disengager through the fluidized bed to conduct a gas-solid separation. The stripped spent catalyst entered the regenerator via the spent catalyst pipeline to contact with air to burn coke and regenerate at a high temperature. The regenerated catalyst was recycled back to the two riser reactors via the regenerated catalyst pipelines for recycle use.

The light gasoline to be reprocessed from the product separation system and the atomized steam were injected through the nozzle at the bottom of the riser reactor 2. The cracked heavy oil and the atomized steam were mixed and introduced through the nozzle at the bottom of the fluidized bed reactor 3.

After contacting with the high-temperature catalyst and reacting, the hydrocarbon product entered the disengager through the fluidized bed, together with the hydrocarbon product from the riser reactor 1, conducted a gas-solid separation in the cyclone separation system at the top of the disengager. The hydrocarbon product was introduced via pipeline to the product separation system. The catalyst was introduced to the fluidized bed reactor. The coke-containing catalyst (the spent catalyst, including those from both the first and second riser reactors) in the fluidized bed reactor was introduced into the stripper. The stripped spent catalyst entered the regenerator via the spent catalyst pipeline to contact with air to burn coke and regenerate at a high temperature. The regenerated catalyst was recycled back to the riser reactors via the regenerated catalyst pipelines for recycle use.

The major operation conditions and results of this example are listed in Table 5, and the properties of a part of the liquid products are listed in Table 6.

Example 5

This example was carried out in the same apparatus as Example 4. Compared with Example 4, in addition to adjusting the operation conditions, the C4 fraction reprocessing was added, i.e. the C4 fraction to be reprocessed from the product separation system entered the pre-lifting section of the riser reactor 2 to contact with the catalyst and react. The major operation conditions and results of this example are listed in Table 7, and the properties of a part of the liquid products are listed in Table 8.

From the results of Tables 5-8, it can be seen that the process of the invention is characterized by a low dry gas yield and a high propylene yield, and at the same time, producing the cracked gasoline with a high aromatic content, which can be used as the aromatic extraction feedstock. The cracked light cycle oil is improved to a certain degree, has a cetane number of 22, and can be used as the fuel oil component.

Example 6

This example was carried out in the same apparatus as the Example 4. Compared with Example 4, in addition to adjusting the operation conditions, the feedstocks were replaced with the feedstock E and F with a E/F ratio of 1:1. This example was operated with reprocessing only the cracked heavy oil. A high-temperature regenerated catalyst entered the bottom of the reaction sections of the first riser reactor and the second riser reactor respectively via the regenerated catalyst pipelines from the regenerator, and flowed upwards under the action of the pre-lifting medium. After pre-heating and mixing with the atomized steam, the feedstock F entered the first riser reactor 1 via the feed nozzle and contacted with the hot regenerated catalyst to conduct the catalytic conversion reaction. The reaction mixture flowed up along the riser reactor 1 and was subjected to a gas-solid separation by a quick separation device at the outlet of the riser reactor 1. The hydrocarbon product entered the disengager and then was introduced into a product separation system to be separated into gas products and liquid products, wherein the cracked heavy oil fraction was reprocessed as the feedstock of the fluidized bed reactor 3 to continue the catalytic conversion. A coke-containing catalyst (a spent catalyst) from the riser 1 firstly flowed into the fluidized bed reactor 3 due to its gravity, mixed with the catalyst and the hydrocarbon product at the outlet of the riser reactor 2, and then entered a stripper communicated with the fluidized bed. The stripping steam, after stripping off the hydrocarbon products absorbed on the spent catalyst, entered the disengager through the fluidized bed to conduct a gas-solid separation. The stripped spent catalyst entered the regenerator via the spent catalyst pipeline to contact with air to burn coke and regenerate at a high temperature. The regenerated catalyst was recycled back to the two riser reactors via the regenerated catalyst pipelines for recycle use.

The feedstock E and the atomized steam were injected through the nozzle at the bottom of the riser reactor 2. The cracked heavy oil and the atomized steam were mixed and introduced through the nozzle at the bottom of the fluidized bed reactor 3. After contacting with the high-temperature catalyst and reacting, the hydrocarbon product entered the disengager through the fluidized bed, together with the hydrocarbon product from the riser reactor 1, conducted a gas-solid separation in the cyclone separation system at the top of the disengager. The hydrocarbon product was introduced via pipeline to the product separation system. The catalyst was introduced to the fluidized bed reactor. The coke-containing catalyst (the spent catalyst, including those from both the first and second riser reactor) in the fluidized bed reactor was introduced into the stripper. The stripped spent catalyst entered the regenerator via the spent catalyst pipeline to contact with air to burn coke and regenerate at a high temperature. The regenerated catalyst was recycled back to the riser reactors via the regenerated catalyst pipelines for recycle use.

The major operation conditions and results of this example are listed in Table 9.

TABLE 1

| Feedstock | A | B | C | E | F |
|---|---|---|---|---|---|
| Density/(g/cm$^3$) | 1.0186 | 0.8950 | 0.6696 | 0.7562 | 0.8850 |
| Refractive index ($n_d^{70}$) | 1.5835 | 1.4888 | / | | |
| Kinematic viscosity/(mm$^2$/s) | | | | | |
| 80° C. | 22.46 | 34.92 | / | | |
| 100° C. | 10.89 | 20.09 | / | | |
| freezing point/° C. | 16 | 48 | / | | |
| w(residual carbon)/% | 1.61 | 6.05 | / | | |
| Elemental composition | | | | | |
| w(C/H)/% | 89.40/9.40 | 86.34/13.10 | 85.18/14.44 | 83.31/13.43 | 86.37/12.22 |
| w(S/N)/% | 1.00/0.25 | 0.32/.24 | 0.015/0.001 | / | 0.0011/<0.0005 |

TABLE 1-continued

| Feedstock | A | B | C | E | F |
|---|---|---|---|---|---|
| Group composition | | | | | |
| w(saturated hydrocarbon/aromatic hydrocarbon)/% | 32.3/65.6 | 57.1/20.2 | / | / | |
| w(Resins/asphaltene)/% | 2.1/0.0 | 22.5/0.2 | / | / | |
| Metal content/(μg/g) | | | | | |
| Ni/V | 0.20/0.29 | 18.30/0.27 | / | / | <0.1/0.3 |
| Distillation range/° C. | | | | | |
| IBP | 274 | 278 | 32 | 42 | 202 |
| 5% | 380 | 362 | 39 | 66 | 280 |
| 10% | 403 | 393 | 40 | 78 | 305 |
| 30% | 427 | 447 | 44 | 107 | 354 |
| 50% | 443 | 503 | 48 | 140 | 402 |
| 70% | 464 | 539(57.8) | 53 | 174 | 463 |
| 90% | 506 | | 65 | 238 | 540 |
| 95% | 534 | | 69 | 267 | |

TABLE 2

| Catalyst | MMC-2 |
|---|---|
| Chemical composition, wt % | |
| $Al_2O_3$ | 49.2 |
| $Na_2O$ | 0.072 |
| $RE_2O_3$ | 0.61 |
| Physical properties | |
| Total pore volume, ml/g | 0.208 |
| Micropore volume, ml/g | 0.024 |
| Specific surface, $m^2/g$ | 155 |
| Zeolite specific surface, $m^2/g$ | 50 |
| Matrix specific surface, $m^2/g$ | 105 |
| Bulk density, g/ml | 0.72 |
| Size distribution, ϕ % | |
| 0-20 μm | 1.6 |
| 0-40 μm | 14.2 |
| 0-80 μm | 53.8 |
| 0-110 μm | 72.6 |
| 0-149 μm | 89.5 |
| Micro Activity, wt % | 66 |

TABLE 3

| Example | Ex. 1 | Comp. 1 |
|---|---|---|
| Feedstock | A and C | A and C |
| Reaction pressure, MPa(a) | 0.21 | 0.21 |
| Regeneration temperature, ° C. | 700 | 700 |
| Reactor structure | Riser + fluidized bed | Only riser |
| Riser length, mm | 3200 | 3800 |
| Fluidized bed reactor height, mm | 600 | / |
| Reaction temperature, ° C. | 520 | 520 |
| Injection mode of light gasoline and cracked heavy oil | injection by mixing | injection by mixing |
| Injection site of light gasoline | riser bottom | riser bottom |
| Injection site of Cracked heavy oil | riser bottom | riser bottom |
| Injection ratio of light gasoline to cracked heavy oil | 1:1.5 | 1:1.5 |
| Total atomized steam ratio, wt % | 13 | 13 |
| Total catalyst/oil ratio, (weight ratio) | 8 | 8 |

TABLE 3-continued

| Example | Ex. 1 | Comp. 1 |
|---|---|---|
| Reaction conditions for light gasoline | | |
| catalyst/oil ratio of light gasoline, (weight ratio) | 20.0 | 20.0 |
| Riser reaction time for light gasoline, s | 0.91 | 1.19 |
| Total reaction time for light gasoline, s | 1.16 | 1.19 |
| the atomized steam/light gasoline ratio, wt % | 10.00 | 10.00 |
| Reaction conditions for cracked heavy oil | | |
| catalyst/oil ratio of cracked heavy oil, (weight ratio) | 13.3 | 13.3 |
| Riser reaction time for cracked heavy oil, s | 0.91 | 1.19 |
| Total reaction time for cracked heavy oil, s | 1.16 | 1.19 |
| Atomized steam/cracked heavy oil ratio, wt % | 15 | 15 |
| Bed temperature, ° C. | 520 | / |
| Bed space velocity, $h^{-1}$ | 10 | / |
| Catalyst | MMC-2 | MMC-2 |
| Material balance, wt % | | |
| $H_2$—C2 | 3.20 | 2.50 |
| C3-C4 | 27.59 | 22.56 |
| C5 + cracked gasoline | 35.88 | 37.36 |
| Cracked light cycle oil | 14.09 | 12.08 |
| Cracked heavy oil | 12.74 | 19.71 |
| Coke | 6.50 | 5.79 |
| Total | 100.00 | 100.00 |
| Light hydrocarbon yield, wt % | | |
| Ethylene | 1.78 | 1.34 |
| Propylene | 14.05 | 10.36 |
| Total butylenes | 12.77 | 9.99 |

TABLE 4

| Example | Ex. 2 | Comp. 2 | Ex. 3 |
|---|---|---|---|
| Feedstock | A and C | A and C | A and C |
| Reaction pressure, MPa(a) | 0.21 | 0.21 | 0.21 |
| Regeneration temperature, ° C. | 700 | 700 | 700 |
| Reactor structure | riser + fluidized bed | sole riser | riser + fluidized bed |
| Riser length, mm | 3200 | 3800 | 3200 |
| Fluidized bed reactor height, mm | 600 | / | 600 |
| Reaction temperature, ° C. | 560 | 560 | 545 |
| Injection mode of light gasoline and cracked heavy oil | individual injection | individual injection | individual injection |
| Injection site of light gasoline | riser bottom | riser bottom | riser bottom |
| Injection site of Cracked heavy oil | half of riser length | half of riser length | fluidized bed bottom |
| Injection ratio of light gasoline to cracked heavy oil | 1:1 | 1:1 | 1:1.2 |
| Total atomized steam ratio, wt % | 15 | 15 | 14.5 |
| Total catalyst/oil ratio, (weight ratio) | 12 | 12 | 11.3 |
| Reaction conditions for light gasoline | | | |
| Catalyst/oil ratio of light gasoline, (weight ratio) | 24.0 | 24.0 | 24.9 |
| Riser reaction time for light gasoline, s | 0.40 | 0.54 | 0.71 |
| Total reaction time for light gasoline, s | 0.87 | 0.92 | 0.94 |
| the atomized steam/light gasoline ratio, wt % | 20.00 | 20.00 | 20.00 |
| Reaction conditions for cracked heavy oil | | | |
| The amount of coke on the catalyst before contacting the cracked heavy oil, wt % | 0.15 | 0.15 | 0.12 |
| Catalyst/oil ratio of cracked heavy oil, (weight ratio) | 24.0 | 24.0 | 20.7 |
| Riser reaction time for cracked heavy oil, s | 0.40 | 0.54 | / |
| Total reaction time for cracked heavy oil, s | 0.60 | 0.54 | 0.23 |
| Atomized steam/cracked heavy oil ratio, wt % | 10 | 10 | 10 |
| Bed temperature, ° C. | 560 | / | 545 |
| Bed space velocity, $h^{-1}$ | 7 | / | 8 |
| Catalyst | MMC-2 | MMC-2 | MMC-2 |
| Material balance, wt % | | | |
| $H_2$—C2 | 6.50 | 6.23 | 4.50 |
| C3-C4 | 36.17 | 33.00 | 32.00 |
| C5 + cracked gasoline | 29.52 | 31.50 | 30.30 |
| Cracked light cycle oil | 10.45 | 7.43 | 11.50 |
| cracked heavy oil | 10.98 | 15.95 | 16.50 |
| Coke | 6.38 | 5.88 | 5.20 |
| Total | 100.00 | 100.00 | 100.00 |
| Conversion, w % | 78.57 | 76.62 | 72.00 |
| Dry gas yield*100/conversion | 8.27 | 8.13 | 6.25 |
| Light hydrocarbon yield, wt % | | | |
| Ethylene | 3.73 | 3.45 | 2.58 |
| Propylene | 18.10 | 14.86 | 16.01 |
| Total butylene | 13.54 | 11.70 | 11.98 |

TABLE 5

| Example | Ex. 4 |
|---|---|
| Feedstock | B |
| Reaction pressure, MPa(a) | 0.21 |
| Regeneration temperature, ° C. | 700 |
| First riser reactor | |
| Riser outlet temperature, ° C. | 530 |
| Reaction time for hydrocarbon, s | 3 |
| catalyst/oil ratio, (weight ratio) | 9.7 |
| Atomized steam ratio (relative to fresh feedstock), wt % | 8 |
| A combined reactor of the second riser and the fluidized bed | |
| Riser outlet temperature, ° C. | 540 |
| Bed temperature, ° C. | 530 |
| Bed weight hourly space velocity, $h^{-1}$ | 10 |
| Light gasoline reprocessing ratio (relative to fresh feedstock), wt % | 12 |
| FBP of reprocessed light gasoline, ° C. | 85 |
| Injection site of light gasoline | riser bottom |
| Catalyst/oil ratio for light gasoline, (weight ratio) | 15 |
| Riser reaction time for light gasoline, s | 0.6 |
| Total reaction time for light gasoline, s | 1.8 |
| Atomized steam/light gasoline ratio, wt % | 15 |
| Cracked heavy oil reprocessing ratio (relative to fresh feedstock), wt % | 20 |
| Injection site of Cracked heavy oil | fluidized bed bottom |
| Reaction time for cracked heavy oil, s | 1.2 |
| Atomized steam/cracked heavy oil ratio, wt % | 10 |
| Catalyst | MMC-2 |
| Material balance, wt % | |
| $H_2$—C2 | 5.32 |
| C3-C4 | 34.72 |
| C5 + cracked gasoline | 31.28 |
| Cracked light cycle oil | 13.31 |
| cracked heavy oil | 5.73 |
| Coke | 9.64 |
| Total | 100.00 |
| Light hydrocarbon yield (relative to fresh feedstock), wt % | |
| Ethylene | 2.81 |
| Propylene | 16.41 |
| Isobutene | 5.48 |

Said fresh feedstock in Table 5 refers to the heavy feedstock introduced into the first riser reactor.

TABLE 6

| Stream | Cracked gasoline | Cracked light cycle oil |
|---|---|---|
| Density (20° C.)/(g/cm$^3$) | 0.75 | 0.91 |
| Kinematic viscosity (20° C.), mm$^2$/s | / | 5.2 |
| Octane number | | / |
| RON | 97 | / |
| MON | 82 | / |
| Cetane number | / | 30 |
| Group composition/wt % | | / |
| Alkanes | 27 | / |
| Olefins | 35 | / |
| Aromatic hydrocarbons | 38 | / |
| Distillation range, ° C. | | / |
| IBP | 44 | / |
| 10% | 85 | / |
| 30% | 121 | / |
| 50% | 134 | / |
| 70% | 146 | / |
| 90% | 172 | / |
| FBP | 200 | / |

TABLE 7

| Example | Ex. 5 |
|---|---|
| Feedstock | B |
| Reaction pressure, MPa(a) | 0.21 |
| Regeneration temperature, ° C. | 700 |
| first riser reactor | |
| Riser outlet temperature, ° C. | 550 |
| Reaction time for hydrocarbon, s | 2.5 |
| catalyst/oil ratio, (weight ratio) | 12.4 |
| Atomized steam ratio (relative to fresh feedstock), wt % | 15 |
| A combined reactor of the second riser and the fluidized bed | |
| Riser outlet temperature, ° C. | 560 |
| Bed temperature, ° C. | 548 |
| Bed weight hourly space velocity, $h^{-1}$ | 5 |
| C4 hydrocarbon reprocessing ratio (relative to fresh feedstock), wt % | 8 |
| Injection site of C4 hydrocarbon | Pre-lifting section of the riser |
| Catalyst/oil ratio of C4 hydrocarbon, (weight ratio) | 29 |
| Riser reaction time for C4 hydrocarbon, s | 0.78 |
| Total reaction time for C4 hydrocarbon, s | 1.78 |
| C4 hydrocarbon/atomized steam ratio, wt % | 10 |
| Light gasoline reprocessing ratio (relative to fresh feedstock), wt % | 10 |
| FBP of reprocessed light gasoline, ° C. | 85 |
| Injection site of light gasoline | riser bottom |
| Catalyst/oil ratio for light gasoline, (weight ratio) | 23 |
| Riser reaction time for light gasoline, s | 0.55 |
| Total reaction time for light gasoline, s | 1.55 |
| the atomized steam/light gasoline ratio, wt % | 15 |
| Cracked heavy oil reprocessing ratio (relative to fresh feedstock), wt % | 10 |
| Injection site of Cracked heavy oil | fluidized bed bottom |
| Reaction time for cracked heavy oil, s | 1.0 |
| Atomized steam/cracked heavy oil ratio, wt % | 10 |
| Catalyst | MMC-2 |
| Material balance, wt % | |
| $H_2$—C2 | 8.15 |
| C3-C4 | 44.93 |
| C5 + cracked gasoline | 21.86 |
| Cracked light cycle oil | 10.84 |
| Cracked heavy oil | 4.39 |
| Coke | 9.83 |
| Total | 100.00 |
| Light hydrocarbon yield (relative to fresh feedstock), wt % | |
| Ethylene | 3.81 |
| Propylene | 23.38 |
| Isobutene | 4.25 |

Said fresh feedstock in Table 7 refers to the heavy feedstock introduced into the first riser reactor.

TABLE 8

| Stream | Cracked gasoline | Cracked light cycle oil |
|---|---|---|
| Density (20° C.)/(g/cm$^3$) | 0.82 | 0.92 |
| Kinematic viscosity (20° C.), mm$^2$/s | | 6 |
| Octane number | | / |
| RON | 100 | / |
| MON | 85 | / |
| Cetane number | | 22 |
| Group composition/wt % | | / |
| Alkanes | 12.1 | / |
| Olefins | 13.2 | / |
| Aromatic hydrocarbons | 74.7 | / |
| Distillation range, ° C. | | / |
| IBP | 40 | / |
| 10% | 88 | / |

TABLE 8-continued

| Stream | Cracked gasoline | Cracked light cycle oil |
|---|---|---|
| 30% | 125 | / |
| 50% | 140 | / |
| 70% | 150 | / |
| 90% | 180 | / |
| FBP | 202 | / |

TABLE 9

| Example | Ex. 6 |
|---|---|
| Feedstock | E and F |
| Reaction pressure, MPa(a) | 0.21 |
| Regeneration temperature, ° C. | 700 |
| first riser reactor | |
| Feedstocks | Feedstock F |
| Riser outlet temperature, ° C. | 580 |
| Reaction time for hydrocarbon, s | 3 |
| catalyst/oil ratio, w/w | 9.7 |
| Injected steam ratio (relative to feedstock F), wt % | 8 |
| A combined reactor of the second riser and the fluidized bed | |
| Fresh feedstocks | Feedstock E |
| Reprocessed stream | Cracked heavy oil |
| Riser outlet temperature, ° C. | 600 |
| Bed temperature, ° C. | 580 |
| Bed weight hourly space velocity, $h^{-1}$ | 10 |
| Injection site of feedstock E | riser bottom |
| Catalyst/oil ratio of feedstock E, w/w | 15 |
| Riser reaction time for feedstock E, s | 0.6 |
| Total reaction time for feedstock E, s | 1.8 |
| Injected steam ratio, wt % | 15 |
| Cracked heavy oil reprocessing ratio (relative to feedstock F), wt % | 5 |
| Injection site of Cracked heavy oil | fluidized bed bottom |
| Reaction time for cracked heavy oil, s | 1.2 |
| Injected steam ratio (relative to cracked heavy oil), wt % | 10 |
| Catalyst | MMC-2 |
| Material balance (relative to feedstock E + F), wt % | |
| $CO_2$&CO | 1.41 |
| $H_2$—C2 | 13.56 |
| C3-C4 | 45.82 |
| C5 + cracked gasoline | 23.10 |
| Cracked light cycle oil | 7.23 |
| Cracked heavy oil | 0.70 |
| Generated water, | 1.48 |
| Coke | 6.70 |
| Total | 100.00 |
| Light hydrocarbon yield(relative to feedstock E + F), w % | |
| Ethylene | 7.52 |
| Propylene | 23.44 |
| Isobutene | 6.01 |

The invention claimed is:

1. A catalytic cracking process, comprising:

contacting a heavy feedstock and optionally an atomized steam with a catalyst containing a shape-selective zeolite having an average pore size of less than 0.7 nm in a first riser reactor to produce a first effluent comprising a first hydrocarbon product and a first coked catalyst;

separating said first hydrocarbon product from said first coked catalyst in a separation device disposed downstream from the first riser;

contacting a light feedstock and optionally an atomized steam with the catalyst containing a shape-selective zeolite having an average pore size of less than 0.7 nm in a second riser reactor to produce a second effluent comprising a second hydrocarbon product and a second coked catalyst;

separating said first product in a product separation system to obtain a cracked gas, a cracked gasoline, a cracked light cycle oil, and a cracked heavy oil;

feeding all or a part of the cracked heavy oil into the second riser, or into a fluidized bed reactor fluidly connected in series with said second riser reactor, or into both said second riser and said fluidized bed reactor;

feeding the second effluent into the fluidized bed reactor to continue reacting therein and obtaining a third effluent comprising a third hydrocarbon product and a third coked catalyst from the fluidized bed reactor.

2. The catalytic cracking process according to claim 1, wherein said heavy feedstock comprises heavy hydrocarbons and/or hydrocarbon-rich animal or vegetable oils; wherein said light feedstock comprises gasoline fractions and/or C4 hydrocarbons; wherein said cracked heavy oil is a cracked heavy oil having an atmospheric distillation range of 330-550° C.

3. The catalytic cracking process according to claim 2, wherein said light feedstock of gasoline fraction is an olefin-rich gasoline fraction which has an olefin content of 20-95 wt % and a final boiling point of not more than 85° C.; and said light feedstock of C4 hydrocarbon is an olefin-rich C4 hydrocarbon which has a C4-olefin content of more than 50 wt %.

4. The catalytic cracking process according to claim 2, wherein said light feedstock comprises said cracked gasoline from said product separation system.

5. The catalytic cracking process according to claim 2, further comprising feeding said first hydrocarbon product and said third hydrocarbon product into said product separation system for separation.

6. The catalytic cracking process according to claim 1, wherein said first riser has a weight ratio between said atomized steam to said heavy feedstock of 2-50 wt %, a reaction pressure of 0.15-0.3 MPa, a reaction temperature of 480-600° C., a catalyst/oil ratio of 5-20, and a reaction time of 0.50-10 seconds.

7. The catalytic cracking process according to claim 1, wherein said second riser reactor has a reaction temperature of 520-580° C., wherein said light feedstock comprises gasoline fractions, wherein said gasoline fractions to atomized steam ratio is 5-30 wt %, wherein said second riser has a catalyst/oil ratio of 10-30 and a reaction time of 0.10-1.5 seconds.

8. The catalytic cracking process according to claim 1, wherein said fluidized bed reactor has a reaction temperature of 500-580° C., a weight hourly space velocity of 1-35 $h^{-1}$, and a reaction pressure of 0.15-0.3 MPa.

9. The catalytic cracking process according to claim 1, wherein the fluidized bed has a catalyst to cracked heavy oil ratio of 1-50, a weight hourly space velocity of 1-20 $h^{-1}$, and an atomized steam to cracked heavy oil ratio of 5-20 wt %.

10. The catalytic cracking process according to claim 1, wherein a weight ratio of said cracked heavy oil introduced into said second riser reactor and/or said fluidized bed reactor to said heavy feedstock introduced into said first riser reactor is 0.05-0.30:1.

11. The catalytic cracking process according to claim 1, wherein said light feedstock comprises gasoline fractions, wherein a weight ratio of said gasoline fractions introduced into said second riser reactor to said heavy feedstock introduced into said first riser reactor is 0.05-0.20:1.

12. The catalytic cracking process according to claim 1, further comprising: introducing said first coked catalyst into said fluidized bed reactor and introducing a catalyst from said fluidized bed into a stripper; or, introducing said first coked catalyst directly into the stripper.

13. The catalytic cracking process according to claim 1, further comprising stripping said first coked catalyst and/or said third coked catalyst with steam in a stripper and introducing the stripping steam from said stripper into said fluidized bed reactor.

14. The catalytic cracking process according to claim 1, wherein said light feedstock comprises C4 hydrocarbons, wherein said C4 hydrocarbons to atomized steam ratio is 10-40 wt %, wherein said second riser has a catalyst/oil of 12-40 and a reaction time of 0.50-2.0 seconds.

15. The catalytic cracking process according to claim 1, wherein said light feedstock comprises gasoline fractions and C4 hydrocarbons, a weight ratio of C4 hydrocarbons in said light feedstock to said gasoline fractions in said light feedstock is 0-2:1.

* * * * *